US010283068B1

(12) United States Patent
Lv et al.

(10) Patent No.: US 10,283,068 B1
(45) Date of Patent: May 7, 2019

(54) GOA CIRCUIT

(71) Applicant: Shenzhen China Star Optoelectronics Semiconductor Display Technology Co., Ltd., Shenzhen (CN)

(72) Inventors: Xiaowen Lv, Shenzhen (CN); Renlu Chen, Shenzhen (CN)

(73) Assignee: SHENZHEN CHINA STAR OPTOELECTRONICS SEMICONDUCTOR DISPLAY TECHNOLOGY CO., LTD., Shenzhen, Guangdong (CN)

( * ) Notice: Subject to any disclaimer, the term of this patent is extended or adjusted under 35 U.S.C. 154(b) by 0 days.

(21) Appl. No.: 15/742,037

(22) PCT Filed: Dec. 14, 2017

(86) PCT No.: PCT/CN2017/116265
§ 371 (c)(1),
(2) Date: Jan. 5, 2018

(30) Foreign Application Priority Data

Nov. 3, 2017 (CN) ..... 2017 1 1071463

(51) Int. Cl.
*G09G 3/36* (2006.01)

(52) U.S. Cl.
CPC ..... *G09G 3/3677* (2013.01); *G09G 2310/06* (2013.01); *G09G 2310/08* (2013.01)

(58) Field of Classification Search
CPC ... G06F 3/0416; G06F 3/0412; G09G 3/3648; G09G 2310/0286
See application file for complete search history.

(56) References Cited

U.S. PATENT DOCUMENTS

2004/0141137 A1* 7/2004 Hirabayashi ..... G02F 1/134309 349/149
2012/0001878 A1* 1/2012 Kurokawa ..... G06F 3/0412 345/204

(Continued)

FOREIGN PATENT DOCUMENTS

CN 102646400 A 8/2012
CN 106652936 A 5/2017

(Continued)

*Primary Examiner* — Shaheda A Abdin
(74) *Attorney, Agent, or Firm* — Leong C. Lei

(57) ABSTRACT

The invention provides a GOA circuit, each GOA unit of GOA circuit comprising: a pull up control module, an output module, a pull down module, a first pull down maintenance module, and a second pull down maintenance module; wherein the 32$^{nd}$ TFT of first pull down maintenance module and the 33$^{rd}$ TFT of second pull down maintenance module having gate connected to the second node and third node respectively, source connected to the first low voltage signal, and drain connected to the scan signal; the 42$^{nd}$ TFT of first pull down maintenance module, the 43$^{rd}$ TFT of second pull down maintenance module, and the 41$^{st}$ TFT of pull down module having source connected to the second low voltage signal. The first low voltage signal is higher than the second low voltage signal, and the second low voltage signal is higher than low voltage level of the clock signal.

15 Claims, 6 Drawing Sheets

(56) References Cited

U.S. PATENT DOCUMENTS

| | | | | |
|---|---|---|---|---|
| 2016/0266699 | A1* | 9/2016 | Zhao | G09G 3/3677 |
| 2016/0351156 | A1* | 12/2016 | Wu | G11C 19/28 |

FOREIGN PATENT DOCUMENTS

| | | | |
|---|---|---|---|
| CN | 106710503 | A | 5/2017 |
| CN | 107909971 | A | 4/2018 |

* cited by examiner

GOA CIRCUIT

BACKGROUND OF THE INVENTION

1. Field of the Invention

The present invention relates to the field of display techniques, and in particular to a gate driver on array (GOA) circuit.

2. The Related Arts

The liquid crystal display (LCD) provides many advantages, such as thinness, low power-consumption and no radiation, and is widely used in, such as, LCD televisions, mobile phones, personal digital assistants (PDAs), digital cameras, computer screens, laptop screens, and so on. The LCD technology also dominates the field of panel displays.

Most of the LCDs on the current market are of backlight type, which comprises an LCD panel and a backlight module. The operation principle behind LCD is to inject the liquid crystal (LC) molecules between a thin film transistor (TFT) array substrate and a color filter (CF) substrate, and applies a driving voltage between the two substrates to control the rotation direction of the LC molecules to refract the light from the backlight module to generate the image on the display.

In the active LCD, each pixel is electrically connected to a TFT, with a gate (Gate) connected to a horizontal scan line, a source (Source) connected to a data line in a vertical direction, and a drain (Drain) connected to a pixel electrode. When a sufficient positive voltage is applied to a horizontal scan line, all the TFTs connected to the scan line are turned on, the signal voltage loaded on the data line is written into the pixel to control the transmittance of different liquid crystals to achieve the effect of color control. The driving of the horizontal scan line of the current active LCD is mainly executed by an external integrated circuit (IC). The external IC can control the charge and discharge of the horizontal scan line in each stage progressively.

The gate driver on array (GOA) technology, i.e., the array substrate row driving technology, can use the array process of the LCD panel to manufacture the driver circuit of the horizontal scan lines on the substrate at area surrounding the active area to replace the external IC for driving the horizontal scan lines. The GOA technology can reduce the bonding process for external IC and has the opportunity to enhance yield rate and reduce production cost, as well as make the LCD panel more suitable for the production of narrow border display products.

FIG. 1 shows a schematic view of a known GOA circuit. The GOA circuit comprises a plurality of cascaded GOA units, with each of the GOA units comprising a pull-up control module 100', an output module 200', a pull down module 300', a first pull down maintenance module 400', and a second pull down maintenance module 500'. For a positive integer N, except the first to the fourth GOA units and the last fourth to first GOA units, in the N-th GOA unit: the pull-up control module 100' comprises an eleventh TFT T11', the eleventh TFT T11' has a gate connected to cascade-propagate signal ST(N−4)' of the fourth previous GOA unit (i.e. the (N−4)-th GOA unit), the source connected to the scan signal G(N−4)' of the (N−4)-th GOA unit, and the drain connected to the first node Q(N)'. The output module 200' comprises a twenty-first TFT T21', a twenty-second TFT T22' and a first capacitor C1'; the twenty-first TFT T21' has a gate the first node Q(N)', a source connected to a clock signal CK', and a drain outputting a scan signal G(N)'; the twenty-second TFT T22' has a gate connected to the first node Q(N)', a source clock signal CK', and a drain outputting a cascade-propagate signal ST(N)'; the first capacitor C1' has one end connected to the first node Q(N)' and the other end connected to the drain of the twenty-first TFT T21'. The pull down module 300's comprises a forty-first TFT T41', the forty-first TFT 41' has a gate connected to the scan signal G(N+4)' of the fourth next GOA unit (i.e., (N+4)-th GOA unit), a source connected to a first low voltage signal VSS1, and a drain connected to the first node Q(N)'. The first pull down maintenance module 400' comprises a thirty-second TFT T32', a forty-second TFT T42', a fifty-first TFT T51', a fifty-second TFT T52', a fifty-third TFT T53', and a fifty-fourth TFT T54'; the thirty-second TFT T32' has a gate connected to a second node P(N)', a source connected to the first low voltage signal VSS1, and a drain connected to the drain of the twenty-first TFT T21'; the forty-second TFT T42' has a gate connected to the second node P(N)', a source connected to the first low voltage signal VSS1, and a drain connected to the first node Q(N)'; the fifty-one TFT T51' has a gate and a source connected to a first control signal LC1', and a drain connected to a gate of the fifty-third TFT T53'; the fifty-second TFT T52' has a gate of the first node Q(N)', a source connected to the first low voltage signal VSS1, and a drain connected to the drain of the fifty-first TFT T51'; the fifty-third TFT T53' has a source connected to the source of the fifty-first TFT T51', and a drain connected to the second node P(N)'; the fifty-fourth TFT T54' has a gate of the first node Q(N)', a source connected to the first low voltage signal VSS1, and a drain connected to the second node P(N)'. The second pull down maintenance module 500' comprises a thirty-third TFT T33', a forty-third TFT T43', a sixty-first TFT T61', a sixty-second TFT T62', a sixty-third TFT T63', and a sixty-fourth TFT T64'; the thirty-third TFT T33' has a gate connected to a third node K(N)', a source connected to the first low voltage signal VSS1, and a drain connected to the drain of the twenty-first TFT T21'; the forty-third TFT T43' has a gate connected to the third node K(N)', a source connected to the first low voltage signal VSS1, and a drain connected to the first node Q(N)'; the sixty-one TFT T61' has a gate and a source connected to a second control signal LC2', and a drain connected to a gate of the sixty-third TFT T63'; the sixty-second TFT T62' has a gate of the first node Q(N)', a source connected to the first low voltage signal VSS1, and a drain connected to the drain of the sixty-first TFT T61'; the sixty-third TFT T63' has a source connected to the source of the sixty-first TFT T61', and a drain connected to the third node K(N)'; the sixty-fourth TFT T64' has a gate connected to the first node Q(N)', a source connected to the first low voltage signal VSS1, and a drain connected to the third node K(N)'. The first control signal LC1' and the second control signal LC2' have opposite phases. This GOA circuit is simple in structure and has a smaller fanout layout area. But as the resolution and frequency increase, the falling time of the scan signal waveform must be reduced. For this, the known technique is to increase the voltage difference between the low voltage of the clock signal CK' and the first low voltage signal VSS1. A larger voltage difference can reduce the falling time of the scan signal waveform. However, in the structure shown in FIG. 1, increasing the voltage difference between the low voltage of the clock signal CK' and the first low voltage signal VSS1 will result in the increase of the ripple of the scan signal G(N)' outputted by the GOA circuit, and leading to poor display quality.

To address this problem, the known technique is to change the connection of the sources of the forty-first TFT T41', the forty-second TFT T42', and the forty-third TFT T43' from the first low voltage signal VSS1 to a second low voltage signal VSS2 with the same voltage level as the low voltage of the clock signal CK' in order to solve the problem of the increase of the ripple of the scan signal G(N)' outputted by the GOA circuit caused by increasing the voltage difference between the low voltage of the clock signal CK' and the first low voltage signal VSS1. However, as the voltage difference between the low voltage of the clock signal CK' and the first low voltage signal VSS1 is very large, and the second low voltage signal VSS2 having the same voltage level as the low voltage of the clock signal CK', the forty-first TFT T41' of the pull down module 300' will stay in the positive bias for a long duration. As such, the threshold voltage shift of the forty-first TFT T41' is severe and the lifespan of the device is reduced.

SUMMARY OF THE INVENTION

The object of the present invention is to provide a GOA circuit, able to reduce the falling time of the scan signal while reducing the electric stress on the TFT of the pull down module to improve the device lifespan.

To achieve the above object, the present invention provides a GOA circuit, which comprises a plurality of cascaded GOA units, with each GOA unit comprising: a pull up control module, an output module, a pull down module and a first pull down maintenance module;

for a positive integer N, except the first to the fourth GOA units and the last fourth to the last GOA units, in the N-th GOA unit:

the pull up control module receiving a cascade-propagate signal from (N−4)-th GOA unit and a scan signal from the (N−4)-th GOA unit, connected to a first node, for pulling up voltage at the first node based on the cascade-propagate signal from (N−4)-th GOA unit and the scan signal from the (N−4)-th GOA unit; the output module receiving clock signal and connected to the first node, for outputting a scan signal and a cascade-propagate signal under control by the voltage of the first node; the pull down module receiving a scan signal from (N+4)-th GOA unit and a second low voltage signal and connected to the first node, for pulling down the voltage at the first node to voltage level of the second low voltage signal based on the scan signal from the (N−4)-th GOA unit; the first pull down maintenance module receiving the scan signal, a first low voltage signal, and a second low voltage signal, and connected to the first node, for maintaining the scan signal at voltage level of the first low voltage signal and the voltage of the first node at the second low voltage signal under the control of the voltage of the first node;

the first low voltage signal having a voltage level larger than the second low voltage signal, and the second low voltage signal having a voltage level larger than low voltage level of the clock signal.

According to a preferred embodiment of the present invention, the pull down module comprises: a $41^{st}$ TFT, having a gate connected to the scan signal from the (N+4)-th GOA unit, a source connected to the second low voltage signal, and a drain connected to the first node; the first pull down maintenance module comprises: a $32^{nd}$ TFT, a $42^{nd}$ TFT, a $51^{st}$ TFT, a $52^{nd}$ TFT, a $53^{rd}$ TFT, and a $54^{th}$ TFT; the $32^{nd}$ TFT having a gate connected to a second node, a source connected to the first low voltage signal, and a drain connected to the scan signal; the $42^{nd}$ TFT having a gate connected to the second node, a source connected to the second low voltage signal, and a drain connected to the first node; the $51^{st}$ TFT having a gate and a source connected to a first control signal, and a drain connected to a gate of the $53^{rd}$ TFT; the $52^{nd}$ TFT having a gate connected to the first node, a source connected to the second low voltage signal, and a drain connected to the drain of the $51^{st}$ TFT; the $53^{rd}$ TFT having a source connected to the source of the $51^{st}$ TFT and a drain connected to the second node; the $54^{th}$ TFT having a gate connected to the first node, a source connected to the second low voltage signal, and a drain connected to the second node.

According to a preferred embodiment of the present invention, the GOA circuit further comprises a second pull down maintenance module, and the second pull down maintenance module comprises:

a $33^{rd}$ TFT, a $43^{rd}$ TFT, a $61^{st}$ TFT, a $62^{nd}$ TFT, a $63^{rd}$ TFT, and a $64^{th}$ TFT; the $33^{rd}$ TFT having a gate connected to a third node, a source connected to the first low voltage signal, and a drain connected to the scan signal; the $43^{rd}$ TFT having a gate connected to the third node, a source connected to the second low voltage signal, and a drain connected to the first node; the $61^{st}$ TFT having a gate and a source connected to a second control signal, and a drain connected to a gate of the $63^{rd}$ TFT; the $62^{nd}$ TFT having a gate of the first node, a source connected to the second low voltage signal, and a drain connected to the drain of the $61^{st}$ TFT; the $63^{rd}$ TFT having a source connected to the source of the $61^{st}$ TFT, and a drain connected to the third node; the $64^{th}$ TFT having a gate connected to the first node, a source connected to the second low voltage signal, and a drain connected to the third node.

According to a preferred embodiment of the present invention, the first control signal and the second control signal have opposite phases.

According to a preferred embodiment of the present invention, except the first to the fourth GOA units, in the N-th GOA unit: the pull up control module comprises: an $11^{th}$ TFT; the $11^{th}$ TFT having a gate connected to the cascade-propagate signal from the (N−4)-th GOA unit, a source connected to the scan signal from the (N−4)-th GOA unit, and a drain connected to the first node.

According to a preferred embodiment of the present invention, the output module comprises: a $21^{st}$ TFT, a $22^{nd}$ TFT, and a first capacitor; the $21^{st}$ TFT having a gate connected to the first node, a source connected to the clock signal, and a drain outputting the scan signal; the $22^{nd}$ TFT having a gate connected to the first node, a source connected to the clock signal, and a drain outputting the cascade-propagate signal; the first capacitor having one end connected to the first node and the other end connected to the drain of the $21^{st}$ TFT.

According to a preferred embodiment of the present invention, in the first to the fourth GOA units, the pull up control module comprises: an $11^{th}$ TFT, the $11^{th}$ TFT having a gate connected to a circuit start signal, a source connected to a high voltage signal, and a drain connected to the first node.

According to a preferred embodiment of the present invention, except the first to the fourth GOA units, the N-th GOA unit further comprises: a $44^{th}$ TFT; the $44^{th}$ TFT having a gate connected to the circuit start signal, a source connected to the second low voltage signal, and a drain connected to the first node.

According to a preferred embodiment of the present invention, in the last fourth to the last GOA units, the pull down module comprises: a $41^{st}$ TFT, the $41^{st}$ TFT having a gate connected to the circuit start signal, a source connected to the second low voltage signal, and a drain connected to the first node.

According to a preferred embodiment of the present invention, the clock signal comprises: a first clock signal, a second clock signal, a third clock signal, a fourth clock signal, a fifth clock signal, a sixth clock signal, a seventh clock signal, and an eight clock signal, outputted serially; for a non-negative integer X, the (1+8X)-th GOA unit, the (2+8X)-th GOA unit, the (3+8X)-th GOA unit, the (4+8X)-th GOA unit, the (5+8X)-th GOA unit, the (6+8X)-th GOA unit, the (7+8X)-th GOA unit, and the (8+8X)-th GOA unit respectively receive the first clock signal, the second clock signal, the third clock signal, the fourth clock signal, the fifth clock signal, the sixth clock signal, the seventh clock signal, and the eight clock signal;

two adjacent clock signals have rising edges with a gap of ⅛ of cycle of the clock signal, the clock signal has a duty cycle ratio of 0.4;

the circuit start signal has a high voltage duration equal to ¾ of the cycle of the clocks signal;

the circuit start signal has a rising edge earlier than the rising edge of the first clock signal, with a gap of ¼ of the cycle of the clocks signal.

The present invention also provides a GOA circuit, which comprises a plurality of cascaded GOA units, with each GOA unit comprising: a pull up control module, an output module, a pull down module and a first pull down maintenance module;

for a positive integer N, except the first to the fourth GOA units and the last fourth to the last GOA units, in the N-th GOA unit:

the pull up control module receiving a cascade-propagate signal from (N−4)-th GOA unit and a scan signal from the (N−4)-th GOA unit, connected to a first node, for pulling up voltage at the first node based on the cascade-propagate signal from (N−4)-th GOA unit and the scan signal from the (N−4)-th GOA unit; the output module receiving clock signal and connected to the first node, for outputting a scan signal and a cascade-propagate signal under control by the voltage of the first node; the pull down module receiving a scan signal from (N+4)-th GOA unit and a second low voltage signal and connected to the first node, for pulling down the voltage at the first node to voltage level of the second low voltage signal based on the scan signal from the (N−4)-th GOA unit; the first pull down maintenance module receiving the scan signal, a first low voltage signal, and a second low voltage signal, and connected to the first node, for maintaining the scan signal at voltage level of the first low voltage signal and the voltage of the first node at the second low voltage signal under the control of the voltage of the first node;

the first low voltage signal having a voltage level larger than the second low voltage signal, and the second low voltage signal having a voltage level larger than low voltage level of the clock signal;

wherein the pull down module comprising: a $41^{st}$ TFT, having a gate connected to the scan signal from the (N+4)-th GOA unit, a source connected to the second low voltage signal, and a drain connected to the first node; the first pull down maintenance module comprising: a $32^{nd}$ TFT, a $42^{nd}$ TFT, a $51^{st}$ TFT, a $52^{nd}$ TFT, a $53^{rd}$ TFT, and a $54^{th}$ TFT; the $32^{nd}$ TFT having a gate connected to a second node, a source connected to the first low voltage signal, and a drain connected to the scan signal; the $42^{nd}$ TFT having a gate connected to the second node, a source connected to the second low voltage signal, and a drain connected to the first node; the $51^{st}$ TFT having a gate and a source connected to a first control signal, and a drain connected to a gate of the $53^{rd}$ TFT; the $52^{nd}$ TFT having a gate connected to the first node, a source connected to the second low voltage signal, and a drain connected to the drain of the $51^{st}$ TFT; the $53^{rd}$ TFT having a source connected to the source of the $51^{st}$ TFT and a drain connected to the second node; the $54^{th}$ TFT having a gate connected to the first node, a source connected to the second low voltage signal, and a drain connected to the second node;

further comprising a second pull down maintenance module, and the second pull down maintenance module comprising:

a $33^{rd}$ TFT, a $43^{rd}$ TFT, a $61^{st}$ TFT, a $62^{nd}$ TFT, a $63^{rd}$ TFT, and a $64^{th}$ TFT; the $33^{rd}$ TFT having a gate connected to a third node, a source connected to the first low voltage signal, and a drain connected to the scan signal; the $43^{rd}$ TFT having a gate connected to the third node, a source connected to the second low voltage signal, and a drain connected to the first node; the $61^{st}$ TFT having a gate and a source connected to a second control signal, and a drain connected to a gate of the $63^{rd}$ TFT; the $62^{nd}$ TFT having a gate of the first node, a source connected to the second low voltage signal, and a drain connected to the drain of the $61^{st}$ TFT; the $63^{rd}$ TFT having a source connected to the source of the $61^{st}$ TFT, and a drain connected to the third node; the $64^{th}$ TFT having a gate connected to the first node, a source connected to the second low voltage signal, and a drain connected to the third node;

wherein the first control signal and the second control signal having opposite phases;

wherein except the first to the fourth GOA units, in the N-th GOA unit: the pull up control module comprising: an $11^{th}$ TFT; the $11^{th}$ TFT having a gate connected to the cascade-propagate signal from the (N−4)-th GOA unit, a source connected to the scan signal from the (N−4)-th GOA unit, and a drain connected to the first node.

wherein the output module comprising: a $21^{st}$ TFT, a $22^{nd}$ TFT, and a first capacitor; the $21^{st}$ TFT having a gate connected to the first node, a source connected to the clock signal, and a drain outputting the scan signal; the $22^{nd}$ TFT having a gate connected to the first node, a source connected to the clock signal, and a drain outputting the cascade-propagate signal; the first capacitor having one end connected to the first node and the other end connected to the drain of the $21^{st}$ TFT.

The present invention provides the following advantages. The present invention provides a GOA circuit, comprising a plurality of cascaded GOA units, with each GOA unit comprising: a pull up control module, an output module, a pull down module, a first pull down maintenance module, and a second pull down maintenance module; wherein the $32^{nd}$ TFT of the first pull down maintenance module and the $33^{rd}$ TFT of the second pull down maintenance module having a gate connected to the second node and third node respectively, a source connected to the first low voltage signal, and a drain connected to the scan signal; the $42^{nd}$ TFT of the first pull down maintenance module, the $43^{rd}$ TFT of the second pull down maintenance module, and the $41^{st}$ TFT of the pull down module having a source connected to the second low voltage signal; and the first low voltage signal having voltage level larger than the second low voltage signal, the second low voltage signal having voltage level larger than low voltage level of the clock signal. As such, the invention can reduce falling time of the scan signal while reducing the electric stress on the TFT of the pull down module to improve device lifespan.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

To further explain the technique means and effect of the present invention, the following uses preferred embodiments and drawings for detailed description.

Figure 1:
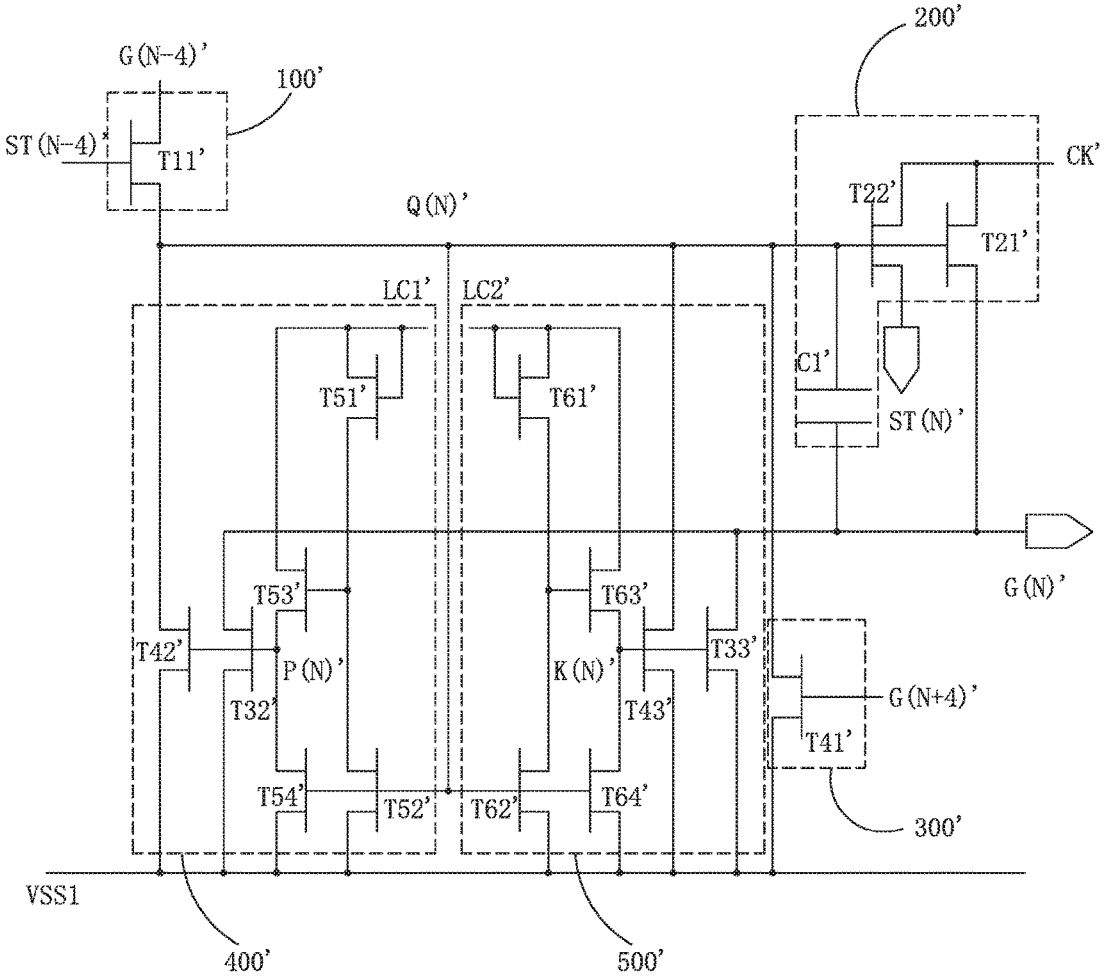
FIG. 1 is a schematic view showing a known GOA circuit.
Figure 2:
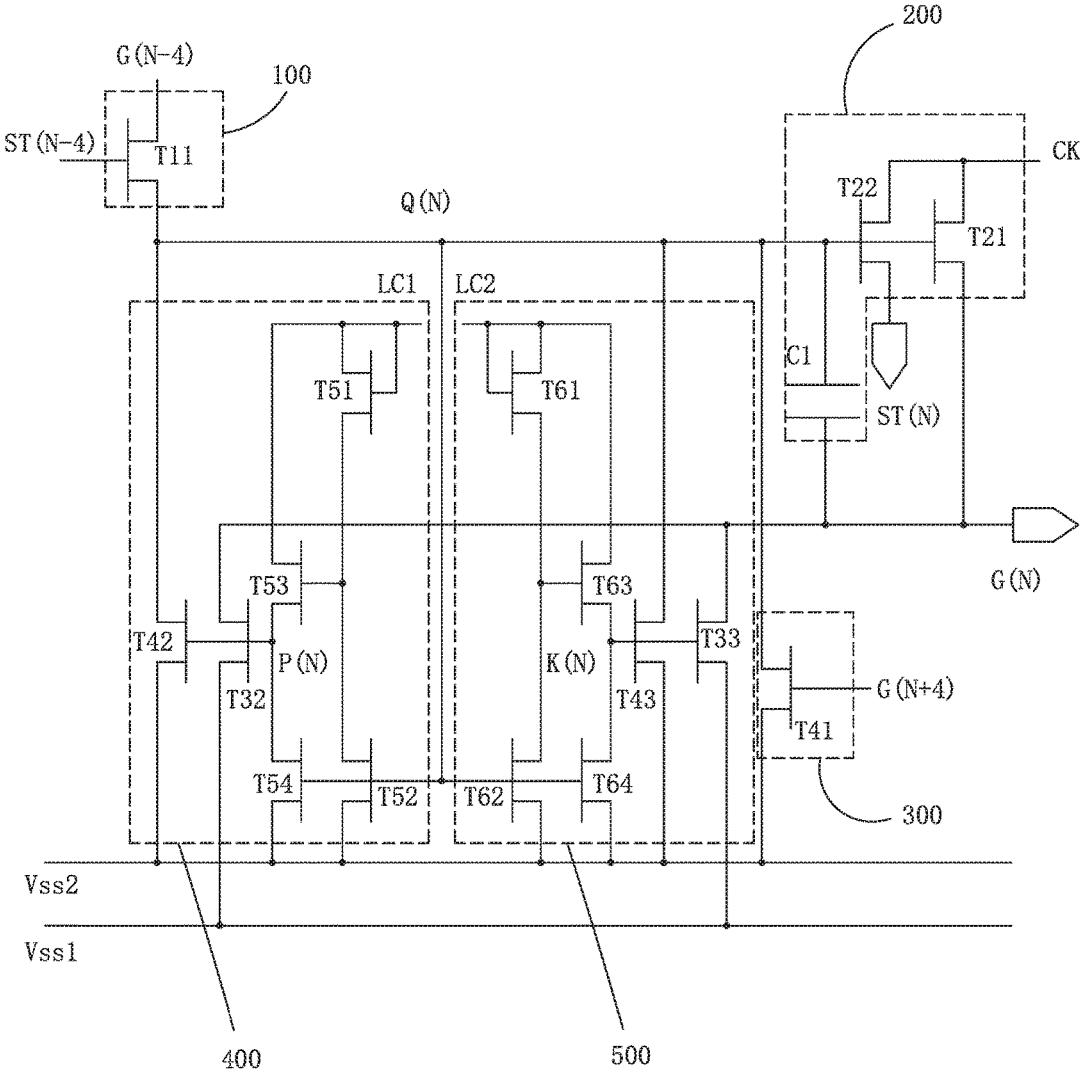
FIG. 2 is a schematic view showing a circuit of the GOA circuit provided by an embodiment of the present invention.

Referring to FIG. 2, the present invention provides a GOA circuit, which comprises: a plurality of cascaded GOA units, with each GOA unit comprising: a pull up control module 100, an output module 200, a pull down module 300, a first pull down maintenance module 400, and a second pull down maintenance module 500;

for a positive integer N, except the first to the fourth GOA units and the last fourth to the last GOA units, in the N-th GOA unit:

the pull up control module 100 receiving a cascade-propagate signal ST(N−4) from the (N−4)-th GOA unit and a scan signal G(N−4) from the (N−4)-th GOA unit, connected to a first node Q(N), for pulling up voltage at the first node Q(N) based on the cascade-propagate signal ST(N−4) from (N−4)-th GOA unit and the scan signal G(N−4) from the (N−4)-th GOA unit.

Specifically, except the first to the fourth GOA units and the last fourth to the last GOA units, in the N-th GOA unit, the pull up control module 100 comprises: an $11^{th}$ TFT T11; the $11^{th}$ TFT T11 having a gate connected to the cascade-propagate signal ST(N−4) from the (N−4)-th GOA unit, a source connected to the scan signal G(N−4) from the (N−4)-th GOA unit, and a drain connected to the first node Q(N).

The output module 200 receives clock signal CK and connected to the first node Q(N), for outputting a scan signal G(N) and a cascade-propagate signal ST(N) under control by the voltage of the first node Q(N).

Specifically, the output module 200 comprises: a $21^{st}$ TFT T21, a $22^{nd}$ TFT T22, and a first capacitor C1; the $21^{st}$ TFT T21 having a gate connected to the first node Q(N), a source connected to the clock signal CK, and a drain outputting the scan signal G(N); the $22^{nd}$ TFT T22 having a gate connected to the first node Q(N), a source connected to the clock signal CK, and a drain outputting the cascade-propagate signal ST(N); the first capacitor C1 having one end connected to the first node Q(N) and the other end connected to the drain of the $21^{st}$ TFT T21.

The pull down module 300 receives a scan signal G(N+4) from (N+4)-th GOA unit and a second low voltage signal Vss2, and is connected to the first node Q(N), for pulling down the voltage level at the first node Q(N) to second low voltage signal Vss2 according to the scan signal G(N+4) of the (N+4)-th GOA unit.

Specifically, the pull down module 300 comprises: a $41^{st}$ TFT T41, the $41^{st}$ TFT T41 having a gate connected to receive a scan signal G(N+4) from (N+4)-th GOA unit, a source connected to the second low voltage signal Vss2, and a drain connected to the first node Q(N).

The first pull down maintenance module 400 receives the scan signal G(N), the first low voltage signal Vss1, and the second low voltage signal Vss2, connected to the first node Q(N), for maintaining the scan signal G(N) at the first low voltage signal Vss1 and the voltage of the first node Q(N) at the second low voltage signal Vss2 under the control of the voltage of the first node Q(N).

Specifically, the pull down maintenance module 400 comprises: a $32^{nd}$ TFT T32, a $42^{nd}$ TFT T42, a $51^{st}$ TFT T51, a $52^{nd}$ TFT T52, a $53^{rd}$ TFT T53, and a $54^{th}$ TFT T54; the $32^{nd}$ TFT T32 having a gate connected to a second node P(N), a source connected to the first low voltage signal Vss1, and a drain connected to the scan signal G(N); the $42^{nd}$ TFT T42 having a gate connected to the second node P(N), a source connected to the second low voltage signal Vss2, and a drain connected to the first node Q(N); the $51^{st}$ TFT T51 having a gate and a source connected to a first control signal LC1, and a drain connected to a gate of the $53^{rd}$ TFT T53; the $52^{nd}$ TFT T52 having a gate connected to the first node Q(N), a source connected to the second low voltage signal Vss2, and a drain connected to the drain of the $51^{st}$ TFT T51; the $53^{rd}$ TFT T53 having a source connected to the source of the $51^{st}$ TFT T51 and a drain connected to the second node P(N); the $54^{th}$ TFT T54 having a gate connected to the first node Q(N), a source connected to the second low voltage signal Vss2, and a drain connected to the second node P(N).

The second pull down maintenance module 500 comprising: a $33^{rd}$ TFT T33, a $43^{rd}$ TFT T43, a $61^{st}$ TFT T61, a $62^{nd}$ TFT T62, a $63^{rd}$ TFT T63, and a $64^{th}$ TFT T64; the $33^{rd}$ TFT T33 having a gate connected to a third node K(N), a source connected to the first low voltage signal Vss1, and a drain connected to the scan signal G(N); the $43^{rd}$ TFT T43 having a gate connected to the third node K(N), a source connected to the second low voltage signal Vss2, and a drain connected to the first node Q(N); the $61^{st}$ TFT T61 having a gate and a source connected to a second control signal LC2, and a drain connected to a gate of the $63^{rd}$ TFT T63; the $62^{nd}$ TFT T62 having a gate of the first node Q(N), a source connected to the second low voltage signal Vss2, and a drain connected to the drain of the $61^{st}$ TFT T61; the $63^{rd}$ TFT T63 having a source connected to the source of the $61^{st}$ TFT T61, and a drain connected to the third node K(N); the $64^{th}$ TFT T64 having a gate connected to the first node Q(N), a source connected to the second low voltage signal Vss2, and a drain connected to the third node K(N).

Moreover, the first control signal LC1 and the second control signal LC2 have opposite phases.

It should be noted that the first low voltage signal Vss1 has a voltage level larger than the second low voltage signal Vss2, the second low voltage signal Vss2 has a voltage level larger than low voltage level of the clock signal CK.

Figure 3:
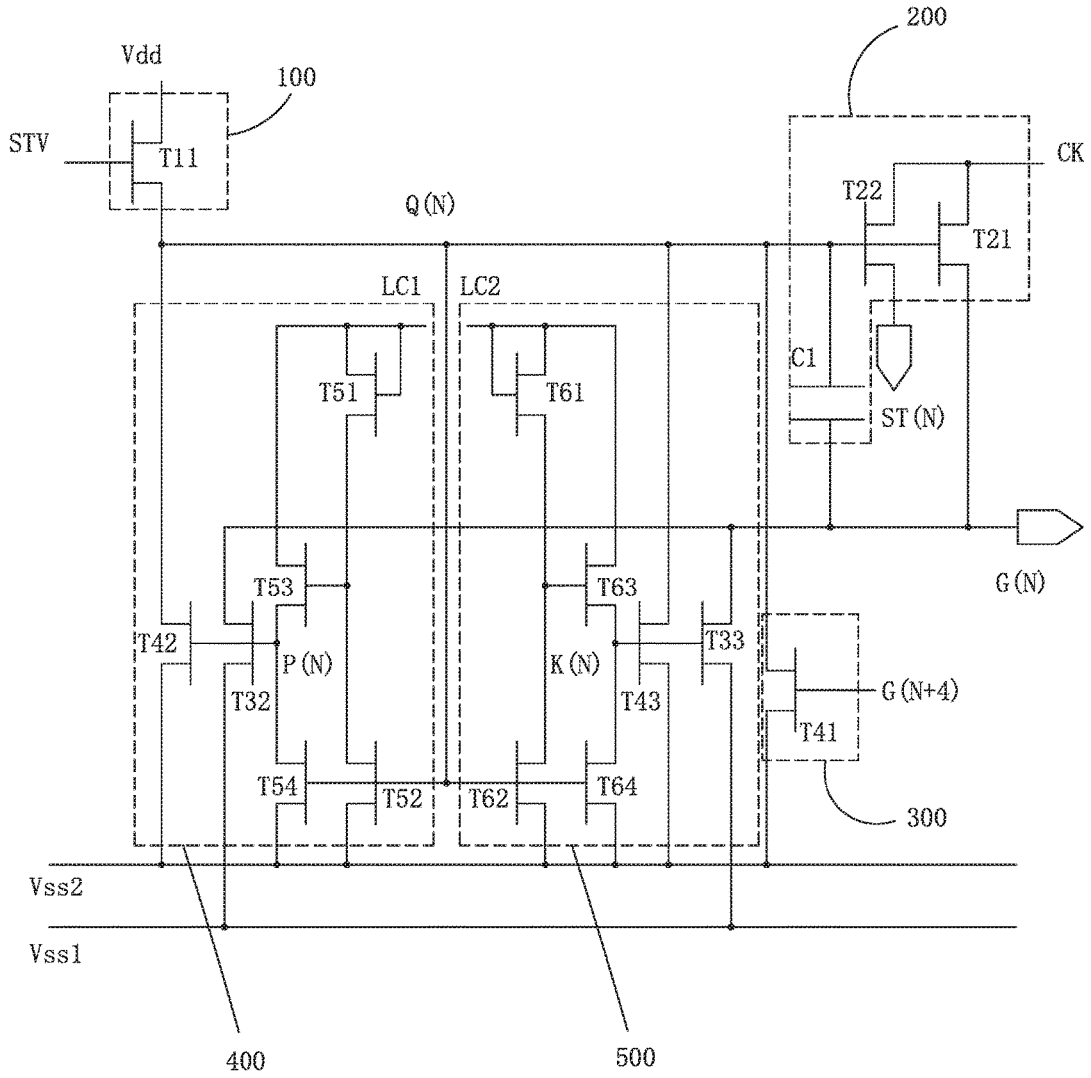
FIG. 3 is a schematic view showing a circuit of the first to the fourth GOA units of the GOA circuit provided by the embodiment of the present invention.

Specifically, as shown in FIG. 3, in the first to the fourth GOA units, the pull up control module 100 comprises: an $11^{th}$ TFT T11, the $11^{th}$ TFT T11 having a gate connected to a circuit start signal STV, a source connected to a high voltage signal Vdd, and a drain connected to the first node Q(N).

Figure 4:
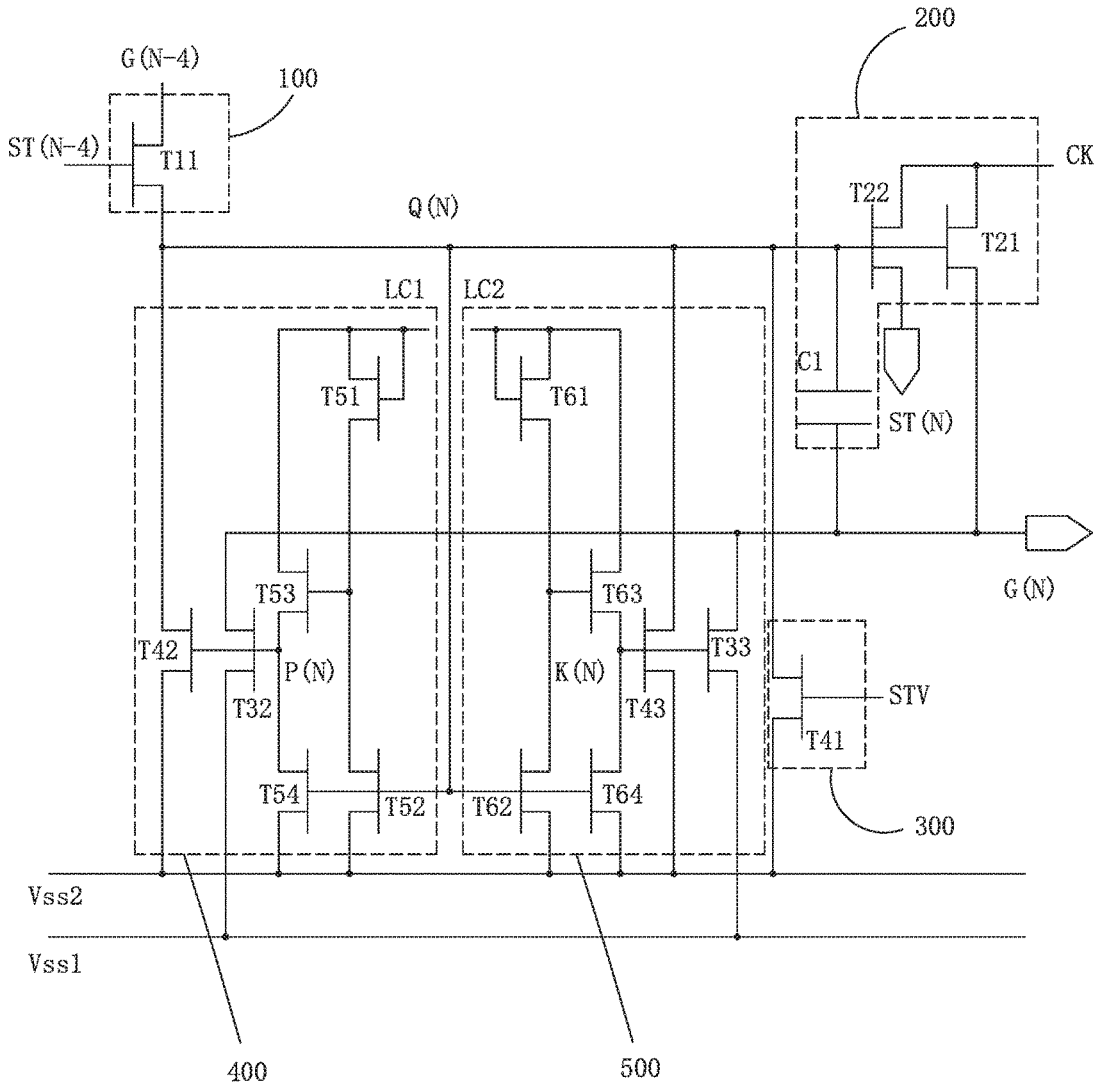
FIG. 4 is a schematic view showing a circuit of the last fourth to the last GOA units of the GOA circuit provided by the embodiment of the present invention.

Specifically, as shown in FIG. 4, in the last fourth to the last GOA units, the pull down module 300 comprises: a $41^{st}$ TFT T41, the $41^{st}$ TFT T41 having a gate connected to the circuit start signal STV, a source connected to the second low voltage signal Vss2, and a drain connected to the first node Q(N).

Figure 5:
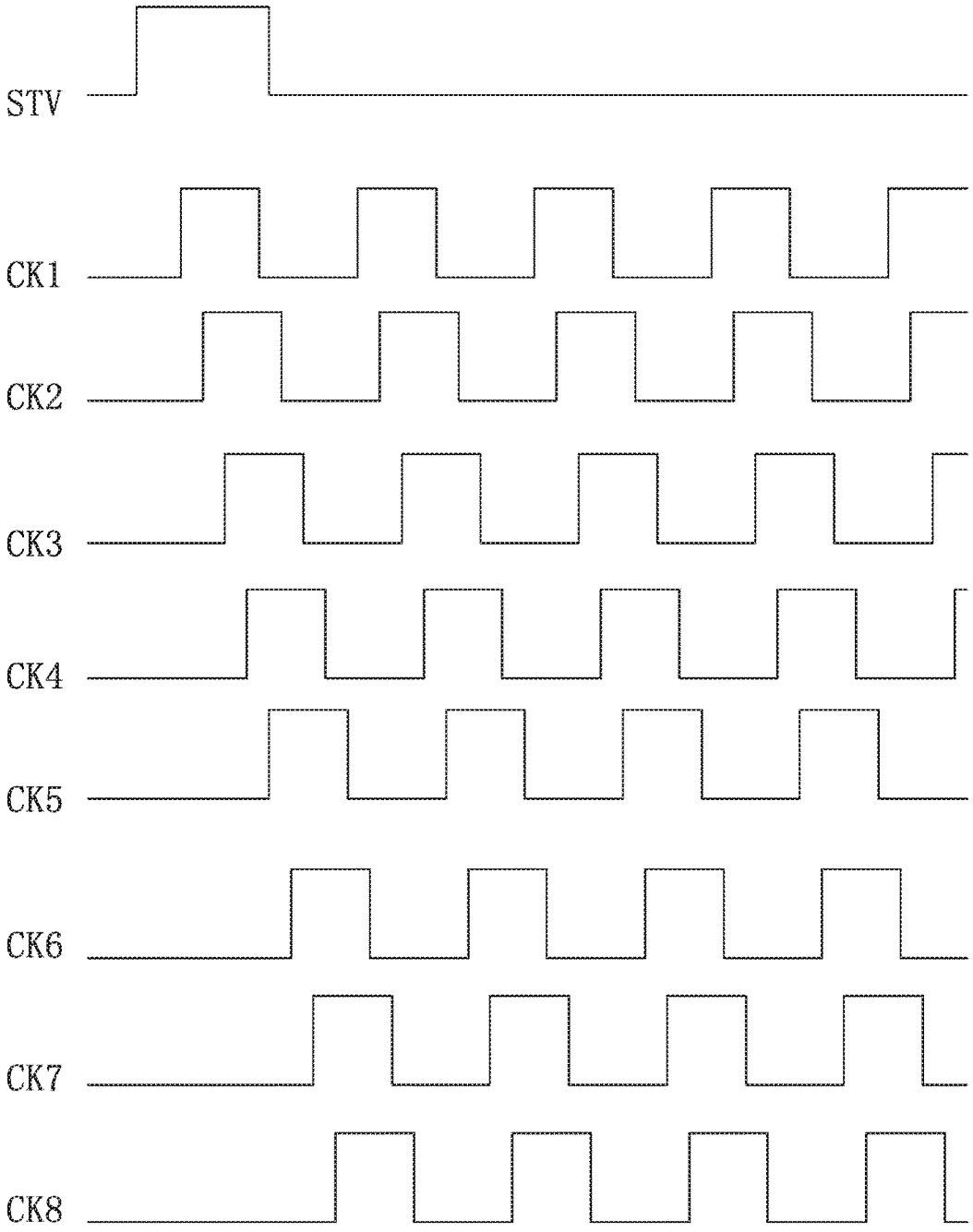
FIG. 5 is a schematic view showing the timing sequence for the GOA circuit by the embodiment of the present invention.

Specifically, as shown in FIG. 5, the clock signal CK comprises: a first clock signal CK1, a second clock signal CK2, a third clock signal CK3, a fourth clock signal CK4, a fifth clock signal CK5, a sixth clock signal CK6, a seventh clock signal CK7, and an eight clock signal CK8, outputted serially; for a non-negative integer X, the (1+8X)-th GOA unit, the (2+8X)-th GOA unit, the (3+8X)-th GOA unit, the (4+8X)-th GOA unit, the (5+8X)-th GOA unit, the (6+8X)-th GOA unit, the (7+8X)-th GOA unit, and the (8+8X)-th GOA unit respectively receive the first clock signal CK1, the second clock signal CK2, the third clock signal CK3, the fourth clock signal CK4, the fifth clock signal CK5, the sixth clock signal CK6, the seventh clock signal CK7, and the eight clock signal CK8;

two adjacent clock signals CK have rising edges with a gap of ⅛ of cycle of the clock signal CK, the clock signal CK has a duty cycle ratio of 0.4;

the circuit start signal SW has a high voltage duration equal to ¾ of the cycle of the clocks signal CK;

the circuit start signal STV has a rising edge earlier than the rising edge of the first clock signal CK1, with a gap of ¼ of the cycle of the clocks signal CK.

Refer to FIG. 2 to FIG. 5. The GOA circuit of the present invention operates as follows: the circuit start signal STV first provides a high voltage, the $11^{th}$ TFT T11 in the first to the fourth GOA units are turned on, and the voltage at the first node Q(N) in the first to the fourth GOA units rises to a high voltage, the $21^{st}$ TFT T21 and the $22^{nd}$ TFT T22 in the first to the fourth GOA units are both turned on, and then the first clock signal CK1 outputs a high voltage. The first GOA unit outputs the scan signal and the cascade-propagate signal; then, the second clock signal CK2 outputs the high voltage, and the second GOA unit outputs the scan signal and the cascade-propagate signal; then, the third clock signal CK3 outputs the high voltage, and the third GOA unit outputs the scan signal and the cascade-propagate signal; and then, the fourth clock signal CK4 outputs the high voltage, and the fourth GOA unit outputs the scan signal and the cascade-propagate signal. The cascade-propagate signals from the first GOA unit, the second GOA unit, the third GOA unit, and the fourth GOA unit are passed respectively to the pull up control module 100 of the fifth GOA unit, the sixth GOA unit, the seventh GOA unit, the eighth GOA unit. After receiving the corresponding cascade-propagate signal, the $11^{th}$ TFT T11 of the fifth GOA unit, the sixth GOA unit, the seventh GOA unit, and the eighth GOA unit is turned on serially, and the fifth clock signal CK5, the sixth clock signal CK6, the seventh clock signal CK7, and the eighth clock signal CK8 serially start to provide a high voltage, and the fifth GOA unit, the sixth GOA unit, the seventh GOA unit, and the eighth GOA unit respectively output the scan signal and the cascade-propagate signal during the time when the fifth clock signal CK5, the sixth clock signal CK6, the seventh clock signal CK7, and the eighth clock signal CK8 are at high voltage. The pull down module 300 of the first GOA unit, the second GOA unit, the third GOA unit, and the fourth GOA unit respectively receives the scan signal from the fifth GOA unit, the sixth GOA unit, the seventh GOA unit, and the eighth GOA unit, and correspondingly pull down the first GOA unit, the second GOA unit, the third GOA unit, and the fourth GOA Unit to the voltage level of the second low voltage signal Vss2, and then the first pull down maintenance module 400 maintains the first node at the voltage level of the second low voltage signal Vss2 and the scan signal at the voltage level of the first low voltage signal Vss1, and so on, until the last fourth GOA unit, the last third GOA unit, the last second GOA unit, and the last GOA unit serially output the scan signal and the cascade-propagate signal, and the circuit start signal STV again provides a high voltage to the pull down module 300 of the last fourth GOA unit, the last third GOA unit, the last second GOA unit, and the last GOA unit to pull down the first node of the last fourth GOA unit, the last third GOA unit, the last second GOA unit, and the last GOA unit to the voltage level of second low voltage signal Vss2 and the first pull down maintenance module 400 or the second pull down maintenance module 500 maintains the first node at the voltage level of the second low voltage signal Vss2 and the scan signal at the voltage level of the first low voltage signal Vss1.

It should be noted that the first low voltage signal Vss1 has a voltage level larger than the second low voltage signal Vss2, the second low voltage signal Vss2 has a voltage level larger than low voltage level of the clock signal CK. As such, the invention can increase the voltage difference between the low voltage level of the clock signal CK and the first low voltage signal Vss1 so as to reduce falling time of the scan signal G(N) and beneficial for application to high-resolution and high-frequency display devices. Also, the use of the second low voltage signal Vss2 can reduce the ripple of the scan signal G(N) to ensure display quality. In addition, even though the voltage difference between the low voltage level of the clock signal CK and the first low voltage signal Vss1 is large, because the voltage level of the second low voltage signal Vss2 is between the low voltage level of the clock signal CK and the first low voltage signal Vss1, the gate-source voltage difference of the $41^{st}$ TFT T41 of the pull down module 300 is the voltage difference between the first low voltage signal Vss1 and the second low voltage signal Vss2 after the scan signal corresponding to the gate of $41^{st}$ TFT T41 is maintained at the first low voltage signal Vss1. Compared to the known technology, the gate-source voltage difference of the $41^{st}$ TFT T41 is smaller and bears a smaller electric stress, which alleviates the threshold voltage shift possibility and effectively increase the device lifespan.

Figure 6:
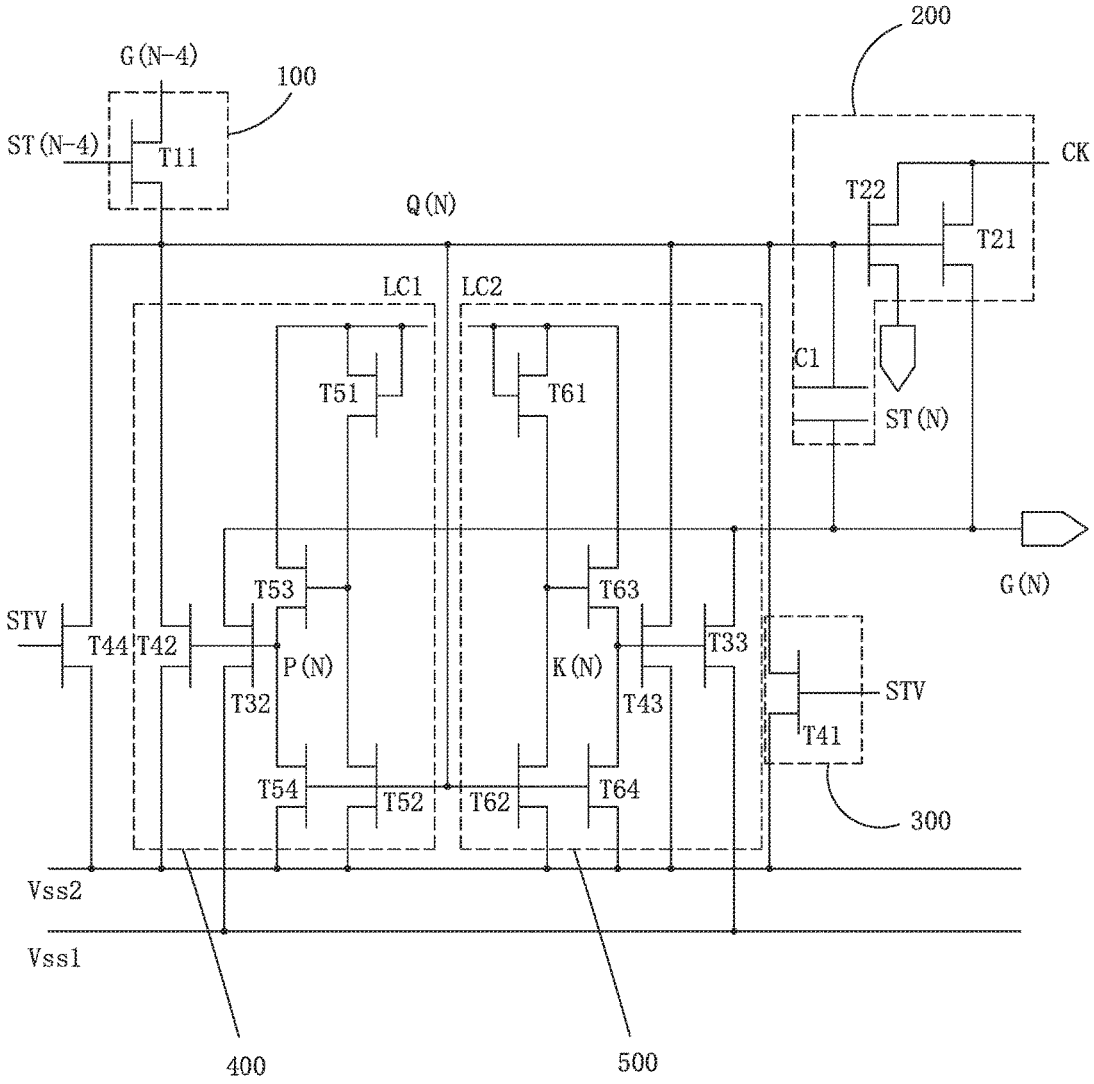
FIG. 6 is a schematic view showing a circuit of the GOA circuit provided by another embodiment of the present invention.

Refer to FIG. 6. FIG. 6 shows another embodiment of the present invention. The difference between the present embodiment and the previous embodiment is that, except the first to the fourth GOA units, the N-th GOA unit further comprises: a $44^{th}$ TFT T44; the $44^{th}$ TFT T44 having a gate connected to the circuit start signal STV, a source connected to the second low voltage signal Vss2, and a drain connected to the first node Q(N). The disposition of the $44^{th}$ TFT T44 has the following effect: when the circuit start signal STV is high, except the first to the fourth GOA units, the voltage level of the first node of all other GOA units is pulled down to the voltage level of second low voltage signal Vss2 through the turned on $44^{th}$ TFT T44; performing reset on the first node of all other GOA units, except the first to the fourth GOA units, to further improve the circuit reliability.

In summary, the present invention provides the following advantages. The present invention provides a GOA circuit, comprising a plurality of cascaded GOA units, with each GOA unit comprising: a pull up control module, an output module, a pull down module, a first pull down maintenance module, and a second pull down maintenance module; wherein the $32^{nd}$ TFT of the first pull down maintenance module and the $33^{rd}$ TFT of the second pull down maintenance module having a gate connected to the second node and third node respectively, a source connected to the first low voltage signal, and a drain connected to the scan signal; the $42^{nd}$ TFT of the first pull down maintenance module, the $43^{rd}$ TFT of the second pull down maintenance module, and the $41^{st}$ TFT of the pull down module having a source connected to the second low voltage signal; and the first low voltage signal having voltage level larger than the second low voltage signal, the second low voltage signal having voltage level larger than low voltage level of the clock signal. As such, the invention can reduce falling time of the scan signal while reducing the electric stress on the TFT of the pull down module to improve device lifespan.

It should be noted that in the present disclosure the terms, such as, first, second are only for distinguishing an entity or operation from another entity or operation, and does not imply any specific relation or order between the entities or operations. Also, the terms "comprises", "include", and other similar variations, do not exclude the inclusion of other non-listed elements. Without further restrictions, the expression "comprises a . . . " does not exclude other identical elements from presence besides the listed elements.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the clams of the present invention.

What is claimed is:

1. A gate driver on array (GOA) circuit, which comprises: a plurality of cascaded GOA units, with each GOA unit comprising: a pull up control module, an output module, a pull down module, a first pull down maintenance module, and a second pull down maintenance module;

for a positive integer N, except the first to the fourth GOA units and the last fourth to the last GOA units, in the N-th GOA unit:

the pull up control module receiving a cascade-propagate signal from (N−4)-th GOA unit and a scan signal from the (N−4)-th GOA unit, connected to a first node, for pulling up voltage at the first node based on the cascade-propagate signal from (N−4)-th GOA unit and the scan signal from the (N−4)-th GOA unit; the output module receiving clock signal and connected to the first node, for outputting a scan signal and a cascade-propagate signal under control by the voltage of the first node; the pull down module receiving a scan signal from (N+4)-th GOA unit and a second low voltage signal and connected to the first node, for pulling down the voltage at the first node to voltage level of the second low voltage signal based on the scan signal from the (N−4)-th GOA unit; the first pull down maintenance module receiving the scan signal, a first low voltage signal, and a second low voltage signal, and connected to the first node, for maintaining the scan signal at voltage level of the first low voltage signal and the voltage of the first node at the second low voltage signal under the control of the voltage of the first node;

the first low voltage signal having a voltage level larger than the second low voltage signal, and the second low voltage signal having a voltage level larger than low voltage level of the clock signal.

2. The GOA circuit as claimed in claim 1, wherein the pull down module comprises: a $41^{st}$ TFT, having a gate connected to the scan signal from the (N+4)-th GOA unit, a source connected to the second low voltage signal, and a drain connected to the first node;

the first pull down maintenance module comprises: a $32^{nd}$ TFT, a $42^{nd}$ TFT, a $51^{st}$ TFT, a $52^{nd}$ TFT, a $53^{rd}$ TFT, and a $54^{th}$ TFT; the $32^{nd}$ TFT having a gate connected to a second node, a source connected to the first low voltage signal, and a drain connected to the scan signal; the $42^{nd}$ TFT having a gate connected to the second node, a source connected to the second low voltage signal, and a drain connected to the first node; the $51^{st}$ TFT having a gate and a source connected to a first control signal, and a drain connected to a gate of the $53^{rd}$ TFT; the $52^{nd}$ TFT having a gate connected to the first node, a source connected to the second low voltage signal, and a drain connected to the drain of the $51^{st}$ TFT; the $53^{rd}$ TFT having a source connected to the source of the $51^{st}$ TFT and a drain connected to the second node; the $54^{th}$ TFT having a gate connected to the first node, a source connected to the second low voltage signal, and a drain connected to the second node.

3. The GOA circuit as claimed in claim 2, further comprising a second pull down maintenance module;

the second pull down maintenance module comprising: a $33^{rd}$ TFT, a $43^{rd}$ TFT, a $61^{st}$ TFT, a $62^{nd}$ TFT, a $63^{rd}$ TFT, and a $64^{th}$ TFT; the $33^{rd}$ TFT having a gate connected to a third node, a source connected to the first low voltage signal, and a drain connected to the scan signal; the $43^{rd}$ TFT having a gate connected to the third node, a source connected to the second low voltage signal, and a drain connected to the first node; the $61^{st}$ TFT having a gate and a source connected to a second control signal, and a drain connected to a gate of the $63^{rd}$ TFT; the $62^{nd}$ TFT having a gate of the first node, a source connected to the second low voltage signal, and a drain connected to the drain of the $61^{st}$ TFT; the $63^{rd}$ TFT having a source connected to the source of the $61^{st}$ TFT, and a drain connected to the third node; the $64^{th}$ TFT having a gate connected to the first node, a source connected to the second low voltage signal, and a drain connected to the third node.

4. The GOA circuit as claimed in claim 3, wherein the first control signal and the second control signal have opposite phases.

5. The GOA circuit as claimed in claim 1, wherein except the first to the fourth GOA units, in the N-th GOA unit: the pull up control module comprises: an $11^{th}$ TFT; the $11^{th}$ TFT having a gate connected to the cascade-propagate signal from the (N−4)-th GOA unit, a source connected to the scan signal from the (N−4)-th GOA unit, and a drain connected to the first node.

6. The GOA circuit as claimed in claim 1, wherein the output module comprises: a $21^{st}$ TFT, a $22^{nd}$ TFT, and a first capacitor; the $21^{st}$ TFT having a gate connected to the first node, a source connected to the clock signal, and a drain outputting the scan signal; the $22^{nd}$ TFT having a gate connected to the first node, a source connected to the clock signal, and a drain outputting the cascade-propagate signal; the first capacitor having one end connected to the first node and the other end connected to the drain of the $21^{st}$ TFT.

7. The GOA circuit as claimed in claim 1, wherein in the first to the fourth GOA units, the pull up control module comprises: an $11^{th}$ TFT, the $11^{th}$ TFT having a gate connected to a circuit start signal, a source connected to a high voltage signal, and a drain connected to the first node.

8. The GOA circuit as claimed in claim 1, wherein except the first to the fourth GOA units, the N-th GOA unit further comprises: a $44^{th}$ TFT; the $44^{th}$ TFT having a gate connected to the circuit start signal, a source connected to the second low voltage signal, and a drain connected to the first node.

9. The GOA circuit as claimed in claim 1, wherein in the last fourth to the last GOA units, the pull down module comprises: a $41^{st}$ TFT, the $41^{st}$ TFT having a gate connected to the circuit start signal, a source connected to the second low voltage signal, and a drain connected to the first node.

10. The GOA circuit as claimed in claim 7, wherein the clock signal comprising: a first clock signal, a second clock signal, a third clock signal, a fourth clock signal, a fifth clock signal, a sixth clock signal, a seventh clock signal, and an eight clock signal, outputted serially; for a non-negative integer X, the (1+8X)-th GOA unit, the (2+8X)-th GOA unit, the (3+8X)-th GOA unit, the (4+8X)-th GOA unit, the (5+8X)-th GOA unit, the (6+8X)-th GOA unit, the (7+8X)-th GOA unit, and the (8+8X)-th GOA unit respectively receiving the first clock signal, the second clock signal, the third clock signal, the fourth clock signal, the fifth clock signal, the sixth clock signal, the seventh clock signal, and the eight clock signal;

two adjacent clock signals having rising edges with a gap of ⅛ of cycle of the clock signal, the clock signal having a duty cycle ratio of 0.4;

the circuit start signal having a high voltage duration equal to ¾ of the cycle of the clocks signal;

the circuit start signal having a rising edge earlier than the rising edge of the first clock signal, with a gap of ¼ of the cycle of the clocks signal.

11. A gate driver on array (GOA) circuit, which comprises: a plurality of cascaded GOA units, with each GOA unit comprising: a pull up control module, an output module, a pull down module, a first pull down maintenance module, and a second pull down maintenance module;

for a positive integer N, except the first to the fourth GOA units and the last fourth to the last GOA units, in the N-th GOA unit:

the pull up control module receiving a cascade-propagate signal from (N−4)-th GOA unit and a scan signal from the (N−4)-th GOA unit, connected to a first node, for pulling up voltage at the first node based on the cascade-propagate signal from (N−4)-th GOA unit and the scan signal from the (N−4)-th GOA unit; the output module receiving clock signal and connected to the first node, for outputting a scan signal and a cascade-propagate signal under control by the voltage of the first node; the pull down module receiving a scan signal from (N+4)-th GOA unit and a second low voltage signal and connected to the first node, for pulling down the voltage at the first node to voltage level of the second low voltage signal based on the scan signal from the (N−4)-th GOA unit; the first pull down maintenance module receiving the scan signal, a first low voltage signal, and a second low voltage signal, and connected to the first node, for maintaining the scan signal at voltage level of the first low voltage signal and the voltage of the first node at the second low voltage signal under the control of the voltage of the first node;

the first low voltage signal having a voltage level larger than the second low voltage signal, and the second low voltage signal having a voltage level larger than low voltage level of the clock signal;

wherein the pull down module comprising: a $41^{st}$ TFT, having a gate connected to the scan signal from the (N+4)-th GOA unit, a source connected to the second low voltage signal, and a drain connected to the first node;

the first pull down maintenance module comprising: a $32^{nd}$ TFT, a $42^{nd}$ TFT, a $51^{st}$ TFT, a $52^{nd}$ TFT, a $53^{rd}$ TFT, and a $54^{th}$ TFT; the $32^{nd}$ TFT having a gate connected to a second node, a source connected to the first low voltage signal, and a drain connected to the scan signal; the $42^{nd}$ TFT having a gate connected to the second node, a source connected to the second low voltage signal, and a drain connected to the first node; the $51^{st}$ TFT having a gate and a source connected to a first control signal, and a drain connected to a gate of the $53^{rd}$ TFT; the $52^{nd}$ TFT having a gate connected to the first node, a source connected to the second low voltage signal, and a drain connected to the drain of the $51^{st}$ TFT; the $53^{rd}$ TFT having a source connected to the source of the $51^{st}$ TFT and a drain connected to the second node; the $54^{th}$ TFT having a gate connected to the first node, a source connected to the second low voltage signal, and a drain connected to the second node;

further comprising a second pull down maintenance module;

the second pull down maintenance module comprising: a $33^{rd}$ TFT, a $43^{rd}$ TFT, a $61^{st}$ TFT, a $62^{nd}$ TFT, a $63^{rd}$ TFT, and a $64^{th}$ TFT; the $33^{rd}$ TFT having a gate connected to a third node, a source connected to the first low voltage signal, and a drain connected to the scan signal; the $43^{rd}$ TFT having a gate connected to the third node, a source connected to the second low voltage signal, and a drain connected to the first node; the $61^{st}$ TFT having a gate and a source connected to a second control signal, and a drain connected to a gate of the $63^{rd}$ TFT; the $62^{nd}$ TFT having a gate of the first node, a source connected to the second low voltage signal, and a drain connected to the drain of the $61^{st}$ TFT; the $63^{rd}$ TFT having a source connected to the source of the $61^{st}$ TFT, and a drain connected to the third node; the $64^{th}$ TFT having a gate connected to the first node, a source connected to the second low voltage signal, and a drain connected to the third node;

wherein the first control signal and the second control signal having opposite phases;

wherein except the first to the fourth GOA units, in the N-th GOA unit: the pull up control module comprising: an $11^{th}$ TFT; the $11^{th}$ TFT having a gate connected to the cascade-propagate signal from the (N−4)-th GOA unit, a source connected to the scan signal from the (N−4)-th GOA unit, and a drain connected to the first node;

the output module comprising: a $21^{st}$ TFT, a $22^{nd}$ TFT, and a first capacitor; the $21^{st}$ TFT having a gate connected to the first node, a source connected to the clock signal, and a drain outputting the scan signal; the $22^{nd}$ TFT having a gate connected to the first node, a source connected to the clock signal, and a drain outputting the cascade-propagate signal; the first capacitor having one end connected to the first node and the other end connected to the drain of the $21^{st}$ TFT.

12. The GOA circuit as claimed in claim 11, wherein in the first to the fourth GOA units, the pull up control module comprises: an $11^{th}$ TFT, the $11^{th}$ TFT having a gate connected to a circuit start signal, a source connected to a high voltage signal, and a drain connected to the first node.

13. The GOA circuit as claimed in claim 11, wherein except the first to the fourth GOA units, the N-th GOA unit further comprises: a $44^{th}$ TFT; the $44^{th}$ TFT having a gate connected to the circuit start signal, a source connected to the second low voltage signal, and a drain connected to the first node.

14. The GOA circuit as claimed in claim 11, wherein in the last fourth to the last GOA units, the pull down module comprises: a $41^{st}$ TFT, the $41^{st}$ TFT having a gate connected to the circuit start signal, a source connected to the second low voltage signal, and a drain connected to the first node.

15. The GOA circuit as claimed in claim 12, wherein the clock signal comprising: a first clock signal, a second clock signal, a third clock signal, a fourth clock signal, a fifth clock signal, a sixth clock signal, a seventh clock signal, and an eight clock signal, outputted serially; for a non-negative integer X, the (1+8X)-th GOA unit, the (2+8X)-th GOA unit, the (3+8X)-th GOA unit, the (4+8X)-th GOA unit, the (5+8X)-th GOA unit, the (6+8X)-th GOA unit, the (7+8X)-th GOA unit, and the (8+8X)-th GOA unit respectively receiving the first clock signal, the second clock signal, the third clock signal, the fourth clock signal, the fifth clock signal, the sixth clock signal, the seventh clock signal, and the eight clock signal;

two adjacent clock signals having rising edges with a gap of ⅛ of cycle of the clock signal, the clock signal having a duty cycle ratio of 0.4;

the circuit start signal having a high voltage duration equal to ¾ of the cycle of the clocks signal;

the circuit start signal having a rising edge earlier than the rising edge of the first clock signal, with a gap of ¼ of the cycle of the clocks signal.

* * * * *